US011580846B2

(12) United States Patent
Gupta et al.

(10) Patent No.: US 11,580,846 B2
(45) Date of Patent: Feb. 14, 2023

(54) ELECTRONIC DEVICE AND METHOD OF CONTROLLING THE SAME

(71) Applicant: Samsung Electronics Co., Ltd., Suwon-si (KR)

(72) Inventors: Ashutosh Gupta, Uttar Pradesh (IN); Gaurav Sikarwar, Uttar Pradesh (IN); Piousb Kumar, Punjab (IN)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/383,945

(22) Filed: Jul. 23, 2021

(65) Prior Publication Data

US 2022/0036724 A1 Feb. 3, 2022

(30) Foreign Application Priority Data

Jul. 28, 2020 (IN) ..... 202041032271
Jul. 9, 2021 (KR) ..... 10-2021-0090388

(51) Int. Cl.
*G08B 26/00* (2006.01)
*G08C 17/02* (2006.01)

(52) U.S. Cl.
CPC ..... *G08B 26/008* (2013.01); *G08C 17/02* (2013.01); *G08C 2201/51* (2013.01)

(58) Field of Classification Search
CPC . G08B 26/008; G08C 2201/51; H04W 76/11; H04L 67/535
See application file for complete search history.

(56) References Cited

U.S. PATENT DOCUMENTS

| | | | | |
|---|---|---|---|---|
| 8,155,588 | B2 | 4/2012 | Dubs et al. | |
| 9,426,285 | B2 | 8/2016 | Agrawal et al. | |
| 2015/0052221 | A1 | 2/2015 | Yoon et al. | |
| 2018/0329957 | A1* | 11/2018 | Frazzingaro | G06F 16/24564 |
| 2019/0044745 | A1* | 2/2019 | Knudson | H04W 4/08 |
| 2019/0207657 | A1* | 7/2019 | Cao | H04W 72/04 |
| 2021/0211858 | A1* | 7/2021 | Ellenbeck | H04W 72/0466 |

FOREIGN PATENT DOCUMENTS

WO 2011/028089 A2 3/2011

* cited by examiner

*Primary Examiner* — Mirza F Alam
(74) *Attorney, Agent, or Firm* — Jefferson IP Law, LLP

(57) ABSTRACT

A method of controlling an electronic device is provided. The method includes transmitting a communication signal to a plurality of candidate devices in the vicinity of the electronic device, generating a function code including configuration information of the electronic device, receiving candidate function codes including configuration information of the plurality of candidate devices from the plurality of candidate devices based on the communication signal, and when a feature of the plurality of candidate devices is determined to be similar to a feature of the electronic device based on the candidate function condes, generating at least one of an alert signal or a setting signal based on whether the function code matches the candidate function codes.

19 Claims, 27 Drawing Sheets

FIG. 6

100

| 602 | | 604 | | 606 | | 608 | | 610 | |
|---|---|---|---|---|---|---|---|---|---|
| ID 612 | Frequency 614 | ID 612 | Frequency 614 | ID 612 | Frequency 614 | ID 612 | Frequency 614 | ID 612 | Frequency 614 |
| 1 | 21000 | 1 | **21100** | 1 | 21100 | 1 | **21600** | 1 | 21600 |
| 2 | 21000 | 2 | 21000 | 2 | 21100 | 2 | 21100 | 2 | 21800 |
| 3 | 21000 | 3 | 21000 | 3 | 21200 | 3 | 21200 | 3 | 21200 |
| 4 | 21000 | 4 | 21000 | 4 | 21400 | 4 | 21400 | 4 | 21400 |

200a

| ID 612 | Frequency 614 | ID 612 | Frequency 614 | ID 612 | Frequency 614 | ID 612 | Frequency 614 | ID 612 | Frequency 614 |
|---|---|---|---|---|---|---|---|---|---|
| 1 | 21000 | 1 | 21000 | 1 | 21100 | 1 | 21100 | 1 | 21600 |
| 2 | 21000 | 2 | **21100** | 2 | 21100 | 2 | **21800** | 2 | 21800 |
| 3 | 21000 | 3 | 21000 | 3 | 21200 | 3 | 21200 | 3 | 21200 |
| 4 | 21000 | 4 | 21000 | 4 | 21400 | 4 | 21400 | 4 | 21400 |

200b

| ID 612 | Frequency 614 | ID 612 | Frequency 614 | ID 612 | Frequency 614 | ID 612 | Frequency 614 | ID 612 | Frequency 614 |
|---|---|---|---|---|---|---|---|---|---|
| 1 | 21000 | 1 | 21000 | 1 | **21100** | 1 | 21100 | 1 | 21600 |
| 2 | 21000 | 2 | 21000 | 2 | **21100** | 2 | 21100 | 2 | 21800 |
| 3 | 21000 | 3 | **21200** | 3 | 21200 | 3 | 21200 | 3 | 21200 |
| 4 | 21000 | 4 | 21000 | 4 | 21400 | 4 | 21400 | 4 | 21400 |

200n

| ID 612 | Frequency 614 | ID 612 | Frequency 614 | ID 612 | Frequency 614 | ID 612 | Frequency 614 | ID 612 | Frequency 614 |
|---|---|---|---|---|---|---|---|---|---|
| 1 | 21000 | 1 | 21000 | 1 | **21100** | 1 | 21100 | 1 | 21600 |
| 2 | 21000 | 2 | 21000 | 2 | **21100** | 2 | 21100 | 2 | 21800 |
| 3 | 21000 | 3 | 21000 | 3 | 21200 | 3 | 21200 | 3 | 21200 |
| 4 | 21000 | 4 | **21400** | 4 | 21400 | 4 | 21400 | 4 | 21400 |

FIG. 7C

| Ringtone 706 | Vibration 708 | LED 710 | FLASH 712 | EDGE 714 | GLOW 716 | Ambient 718 | Visibility 720 |
|---|---|---|---|---|---|---|---|
| **SET** | X | X | X | X | X | N/A | N/A |
| X | SET | SET | SET | **SET** | SET | DARK | EDGE |
| X | SET | SET | **SET** | SET | SET | DARK | FLASH |
| X | SET | **SET** | SET | X | SET | DARK | LED |
| X | SET | SET | **SET** | X | SET | DARK | FLASH |
| X | SET | **SET** | X | X | SET | DARK | LED |
| X | **SET** | SET | SET | SET | SET | BRIGHT | N/A |
| X | SET | SET | X | SET | **SET** | DARK | GLOW |

FIG. 8A

| Alert | Search | IOT | Connectivity | Security |
|---|---|---|---|---|
| A | B | C | D | E |

FIG. 8B

| Ringtone | Notification | Vibration | LED | Smart Glow | Flash | Edge Lightning |
|---|---|---|---|---|---|---|
| A | B | C | D | E | F | G |

FIG.8C

| Atomic bell | Over the Horizon | Sky High | Shooting Star |
|---|---|---|---|
| A | B | C | D |

FIG.8D

| Heartbeat | Siren | Waltz | Ripple |
|---|---|---|---|
| A | B | C | D |

FIG.8E

| Feature Table | Type Table | Value Table | Final Morse Code |
|---|---|---|---|
| A | A | B | AAB |

FIG.8F

| FEATURE | Morse code 804a | TYPE 806 | Morse code 804 b | VALUE 808 | Morse code 804c | Feature codes 810 |
|---|---|---|---|---|---|---|
| ALERT 802 | A | RINGTONE 706 | A | ATOMIC BELL | A | AAA |
| | | | | OVER THE HORIZON | B | AAB |
| | | | | SKY HIGH | C | AAC |
| | | | | SHOOTING STAR | D | AAD |
| | | NOTIFICATION 812 | B | BEEP | A | ABA |
| | | | | BELL | B | ABB |
| | | | | RING | C | ABC |
| | | VIBRATION 708 | C | BASIC | A | ACA |
| | | | | HEARTBEAT | B | ACB |
| | | | | TICKTOCK | C | ACC |
| | | | | WALTZ | D | ACD |
| | | LED 710 | D | RED | A | ADA |
| | | | | GREEN | B | ADB |
| | | | | BLUE | C | ADC |
| | | | | COLORS | D | ADD |
| | | GLOW 716 | E | BLINK | A | AEA |
| | | | | FADE | B | AEB |
| | | | | CONSTANT | C | AEC |
| | | | | COLORS | D | AED |
| | | FLASH 712 | F | BLINK | A | AFA |
| | | | | FLICKER | B | AFB |
| | | | | CONSTANT | C | ABC |
| | | | | FADE | D | AFD |
| | | EDGE 714 | G | RED | A | AGA |
| | | | | GREEN | B | AGB |
| | | | | BLUE | C | AGC |

FIG.9B

| ELECTRONIC DEVICE 100 (AAB) | FIRST CANDIDATE DEVICE 200a (AAB) | SECOND CANDIDATE DEVICE 200b (AAB0) |
|---|---|---|
| AAA (200a) | AAB (100) | AAB (100) |
| AAB (200b) | AAB (200b) | AAA (200a) |
| TRANSMISSION | MATCH, REPLY | NO MATCH |

FIG.11A

| DEVICE POSITION 1102 | PRIMARY ALERT 1104 | ORIENTATION | USER PRESENCE | SECONDARY ALERT 1106 |
|---|---|---|---|---|
| HAND | RINGING | Any | Any | RINGING - NOT REQUIRED<br>VIBRATION - MID INTENSITY |
| POCKET | RINGING | Any | Any | RINGING - NOT REQUIRED<br>VIBRATION - HIGH INTENSITY |
| SURFACE | RINGING | FACING UPWARD | NEARBY | ((RINGING - LOW INTENSITY<br>EDGE PANEL/FRONT FLASH/LED |
| SURFACE | RINGING | FACING UPWARD | FAR AWAY | (((RINGING - HIGH INTENSITY<br>EDGE PANEL/FRONT FLASH/LED |
| SURFACE | RINGING | FACING DOWNWARD | NEARBY | ((RINGING - LOW INTENSITY<br>FLASH |
| SURFACE | RINGING | FACING DOWNWARD | FAR AWAY | (((RINGING - HIGH INTENSITY<br>FLASH |
| POCKET | VIBRATION | Any | Any | RINGING - NOT REQUIRED<br>VIBRATION - CHANGED TO HIGH INTENSITY |
| SURFACE | VIBRATION | FACING UPWARD | NEARBY | RINGING - LOW INTENSITY<br>EDGE PANEL/FRONT FLASH/LED |
| SURFACE | VIBRATION | FACING UPWARD | FAR AWAY | VIBRATION - HIGH INTENSITY<br>EDGE PANEL/FRONT FLASH/LED |
| SURFACE | VIBRATION | FACING DOWNWARD | NEARBY | RINGING - LOW INTENSITY<br>FLASH |
| SURFACE | VIBRATION | FACING DOWNWARD | FAR AWAY | VIBRATION - HIGH INTENSITY<br>FLASH |

| Product | Frequency | Reply Code | Primary alert (1312) | Secondary Alert (1314) |
|---|---|---|---|---|
| First Ear Buds (1302) | 20000 | DAA | Sound (DAA) | Led (DAB) |
| Second Ear Buds (1304) | 20100 | DAA | Sound (DAA) | Led (DAB) |
| Third Ear Buds (1306) | 20200 | DAA | Sound (DAA) | Led (DAB) |
| Bluetooth Speaker (1308) | 20600 | DAA | Led (DAB) | Sound (DAA) |
| Fourth Ear Buds (1310) | 20800 | DAA | Sound (DAA) | Led (DAB) |

1306

| Event | Feature Type | Feature Value | Code (1408) |
|---|---|---|---|
| Connection (D) | Screen Mirror (B) | Wi-Fi (A) | **DBA** |
| | | 5G (B) | DBB |
| | | Li-fi (C) | DBC |

FIG.16A

| Character (1602) | ASCII (1604) | Binary Code (1606) |
|---|---|---|
| a | 097 | 01100001 |
| A | 065 | 01000001 |
| b | 098 | 01100010 |
| B | 066 | 01000010 |
| c | 099 | 01100011 |
| C | 067 | 01000011 |

1610

FIG.16B

| Codes (1608) | Codes (1608) | Codes (1608) | Codes (1608) |
|---|---|---|---|
| A -> 00000 | H -> 00111 | O -> 01110 | V -> 10101 |
| B -> 00001 | I -> 01000 | P -> 01111 | W -> 10110 |
| C -> 00010 | J -> 01001 | Q -> 10000 | X -> 10111 |
| D -> 00011 | K -> 01010 | R -> 10001 | Y -> 11000 |
| E -> 00100 | L -> 01011 | S -> 10010 | Z -> 11001 |
| F -> 00101 | M -> 01100 | T -> 10011 | "SPACE" -> 11010 |
| G -> 00110 | N -> 01101 | U -> 10100 | "END character" -> 11011 |

1612

ELECTRONIC DEVICE AND METHOD OF CONTROLLING THE SAME

CROSS-REFERENCE TO RELATED APPLICATION(S)

This application is based on and claims priority under 35 U.S.C. § 119(a) of an Indian patent application number 202041032271, filed on Jul. 28, 2020, in the Indian Intellectual Property Office, and of a Korean patent application number 10-2021-0090388, filed on Jul. 9, 2021, in the Korean Intellectual Property Office, the disclosure of each of which is incorporated by reference herein in its entirety.

BACKGROUND

1. Field

The disclosure relates to communication between electronic devices. More particularly, the disclosure relates to an electronic device capable of identifying a plurality of electronic devices, and a method of controlling the same.

2. Description of Related Art

Users may select the same alert function for peer-to-peer (PTP) communication between a plurality of electronic devices. The alert function may include a ringtone, an audible notification, a vibration pattern, a flash light, an edge light, a smart glow, and the like. When being activated in a plurality of user terminals in a specific space, the same alert function may cause sudden confusion among users.

As an example, a user may be confused about a position of an electronic device (profile or privacy mode) in a situation in which the user is not aware of a state of the electronic device or desires to change a privacy mode of the electronic device during a conference and a meeting. As another example, a user may be suddenly confused even when the user cannot confirm a current state (on or off-state) of home appliances while operating the home appliances through an electronic device. The home appliances may be non-smart devices or devices for Internet over Things (IoT), and the home appliances may be turned off through a video camera or a smart device such as Alexa available in the home.

Accordingly, it is desirable to solve the above-described problems and provide one or more useful alternatives for detecting similar features between electronic devices.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device capable of detecting similar features between a plurality of devices by generating unique function codes for an electronic device and a plurality of candidate devices, and a method of controlling the same.

Additional aspects will be set forth in part in the description which follows and, in part, will be apparent from the description, or may be learned by practice of the presented embodiments.

In accordance with an aspect of the disclosure, a method of controlling an electronic device is provided. The method includes transmitting a communication signal to a plurality of candidate devices in the vicinity of the electronic device, generating a function code including configuration information of the electronic device, receiving candidate function codes including configuration information of the plurality of candidate devices from the plurality of candidate devices based on the communication signal, and when a feature of the plurality of candidate devices is determined to be similar to a feature of the electronic device based on the candidate function codes, generating at least one of an alert signal or a setting signal based on whether the function code matches the candidate function codes.

The method may further include generating, by each of the electronic device and the plurality of candidate devices, a unique identifier, transmitting the unique identifier to the plurality of candidate devices, and receiving the unique identifiers generated by the plurality of candidate devices.

The method may further include confirming whether the unique identifiers of the plurality of candidate devices are different, when the unique identifier generated by any one of the plurality of candidate devices is the same as the unique identifier of another candidate device, regenerating the unique identifiers, and receiving the regenerated unique identifiers from the plurality of candidate devices.

The transmitting of the communication signal to the plurality of candidate devices may include detecting an event in the vicinity of the electronic device, and transmitting the communication signal to the plurality of candidate devices in the vicinity of the electronic device based on the event. The generating of the function code may include determining a plurality of features of the electronic device and attributes corresponding to the plurality of features, generating the function code based on the attribute, and transmitting the function code to the plurality of candidate devices.

The method may further include transmitting the function code based on a current contextual parameter of the electronic device to the plurality of candidate devices.

The function code and the candidate function code may each include at least one of an ultrasonic Morse code, an American standard for information interchange (ASCII) code, a binary code, or a custom code.

The generating of the at least one of the alert signal or the setting signal based on whether the function code matches the candidate function codes may include at least one of alerting a user of the electronic device or activating/deactivating at least one function of the electronic device based on the alert signal.

The alerting of the user of the electronic device may include alerting the user with a primary alert, a secondary alert, or a combination of the primary alert and the secondary alert.

The similar feature may include at least one of alert types or device names among the electronic device and the plurality of candidate devices.

The method may further include filtering the electronic device and the plurality of candidate devices based on proximity parameters.

The filtering may include performing filtering based on at least one of a position of the plurality of candidate devices, a distance to the electronic device, a speed, or a time.

The method may further include filtering an external device in the vicinity of the electronic device or the plurality of candidate devices.

The unique identifier may be a specific frequency.

In accordance with another aspect of the disclosure, an electronic device is provided. The electronic device includes a memory in which one or more instructions are stored, and a processor configured to execute the stored instructions, when executed, the instructions cause the processor to control to transmit a communication signal to a plurality of candidate devices in the vicinity of the electronic device, generate a function code including configuration information of the electronic device, receive candidate function codes including configuration information of the plurality of candidate devices from the plurality of candidate devices based on the communication signal, and when a feature of the plurality of candidate devices is determined to be similar to a feature of the electronic device based on the candidate function codes, generate at least one of an alert signal or a setting signal based on whether the function code matches the candidate function codes.

The processor may control each of the electronic device and the plurality of candidate devices to generate a unique identifier and may perform control to transmit the unique identifier to the plurality of candidate devices and receive the unique identifiers generated by the plurality of candidate devices.

The processor may perform control to confirm whether the unique identifiers of the plurality of candidate devices are different, regenerate the unique identifiers when the unique identifier generated by any one of the plurality of candidate devices is the same as the unique identifier of another candidate device, and receive the regenerated unique identifiers from the plurality of candidate devices.

The processor may perform control to detect an event in the vicinity of the electronic device and transmit the communication signal to the plurality of candidate devices in the vicinity of the electronic device based on the event.

The processor may perform control to determine a plurality of features of the electronic device and attributes corresponding to the plurality of features, generate the function code based on the attribute, and transmit the function code to the plurality of candidate devices.

The processor may transmit the function code based on a current contextual parameter of the electronic device to the plurality of candidate devices.

In accordance with another aspect of the disclosure, a computer program is coupled to a computing device and stored in a recording medium to execute a method is provided. The method includes transmitting a communication signal to a plurality of candidate devices in the vicinity of the electronic device, generating a function code including configuration information of the electronic device, receiving candidate function codes including configuration information of the plurality of candidate devices from the plurality of candidate devices based on the communication signal, and detecting a similar feature and generating at least one of an alert signal or a setting signal based on whether the function code matches the candidate function codes.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 6 illustrates a randomization lookup table for an electronic device and a plurality of candidate devices according to an embodiment of the disclosure;

FIGS. 7A, 7B, and 7C illustrate an example in which a most prominent function is identified based on a priority parameter table to prioritize features of an electronic device according to various embodiments of the disclosure;

FIGS. 8A, 8B, 8C, 8D, and 8E illustrate an example of the formation of an ultrasonic code according to various embodiments of the disclosure;

FIG. 8F illustrates an example of an ultrasonic code table according to an embodiment of the disclosure;

FIGS. 9A and 9B illustrate an example of a function code matched between an electronic device and a plurality of candidate devices according to various embodiments of the disclosure;

FIG. 11A illustrates an example of a secondary alert of an electronic device according to an embodiment of the disclosure;

FIG. 16A illustrates a table for American standard for information interchange (ASCII) codes encoded as binary codes according to an embodiment of the disclosure; and FIG. 16B illustrates a table for custom codes encoded as binary codes according to an embodiment of the disclosure.

Throughout the drawings, like reference numerals will be understood to refer to like parts, components, and structures.

DETAILED DESCRIPTION

Figure 1:
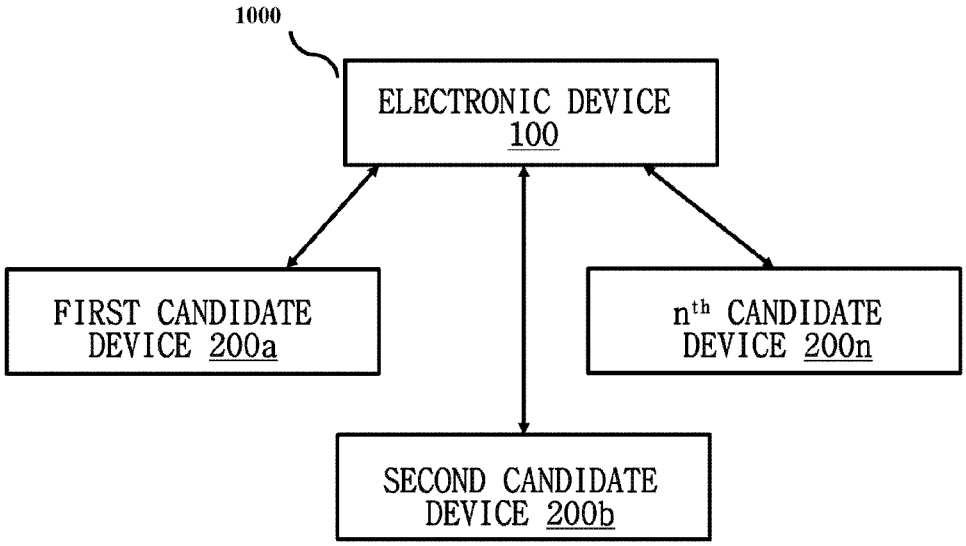
FIG. 1 illustrates a plurality of candidate devices communicating with an electronic device so as to detect a similar feature of the electronic device according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness. The term "or" used herein refers to a non-exclusive or unless otherwise indicated.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As such, embodiments may be described and illustrated in terms of blocks which carry out a described function or functions. These blocks, which may be referred to herein as units, modules, or the like, are physically implemented by analog or digital circuits, such as logic gates, integrated circuits, microprocessors, microcontrollers, memory circuits, passive electronic components, active electronic components, optical components, hardwired circuits, and the like, and may optionally be driven by firmware and software. The circuits may, for example, be embodied as one or more semiconductor chips or embodied on substrate supports such as printed circuit boards and the like. The circuits constituting a block may be implemented by dedicated hardware, by a processor (for example, one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure.

The accompanying drawings are used to help easily understand various technical features, and the embodiments presented herein are not limited by the accompanying drawings. Therefore, it should be understood that the spirit of the disclosure may be expanded to its modifications, replacements, and equivalents in addition to what is shown in the drawings. In addition although the terms including ordinal numbers such as "first," "second," and so on used herein may be used to describe various components, the components are not limited by the terms, and the terms are used only for the purpose of distinguishing one component from another component.

Therefore, embodiments of the disclosure provide a method of detecting a similar feature of an electronic device. The method includes transmitting, by an electronic device, a communication signal to a plurality of candidate devices in the vicinity of the electronic device. The method further includes generating, by the electronic device, a function code. The function code indicates configuration information of the electronic device. The method further includes receiving, by the electronic device, candidate function codes transmitted by the plurality of candidate devices based on the received communication signal. The function code transmitted by the plurality of candidate devices represents configuration information of the plurality of candidate devices. The method further includes determining, by the electronic device, whether the function code of the electronic device matches the candidate function codes received from the plurality of candidate devices. When it is determined that the function code of the electronic device matches the candidate function codes, the method further includes performing, by the electronic device, at least one operation.

Unlike methods and electronic devices according to the related art, in the proposed method, the electronic device notifies an alert despite having the same feature as the plurality of nearby candidate devices. The electronic device transmits a communication signal to the plurality of nearby candidate devices and generates a function code. The plurality of candidate devices also generate candidate function codes. Then, the electronic compares the function code with the candidate function codes to determine whether the function code matches the candidate function codes. When the function code matches the candidate function codes, the electronic device may use different alert types or a combination of alert types to notify a user of the electronic device.

Hereinafter, various embodiments, in which similar reference characters denote corresponding features consistently throughout the accompanying drawings, will be described with reference to the accompanying drawings, and more specifically to FIGS. 1 to 16B.

FIG. 1 illustrates a plurality of candidate devices 200*a* to 200*n* communicating with an electronic device 100 so as to detect a similar feature of the electronic device 100 according to an embodiment of the disclosure.

Referring to FIG. 1, the plurality of candidate devices 200*a* to 200*n* include a first candidate device 200*a*, a second candidate device 200*b*, and an $n^{th}$ candidate device 200*n*. The plurality of candidate devices 200*a* to 200*n* may be connected to each other through a network. For example, the plurality of candidate devices 200*a* to 200*n* or the electronic device 100 may be a smart watch, a smartphone, an artificial intelligence (AI) speaker, an Internet of Things (IoT) sensor, a laptop, a smart social robot, a personal digital assistant (PDA), a tablet computer, a laptop computer, a music player, a video player, or the like but is not limited thereto. In an example, the electronic device 100 may be a smart watch, a smartphone, an AI speaker, an IoT sensor, a laptop, a smart social robot, a PDA, a tablet computer, a laptop computer, a music player, a video player, or the like but is not limited thereto.

Figure 2:
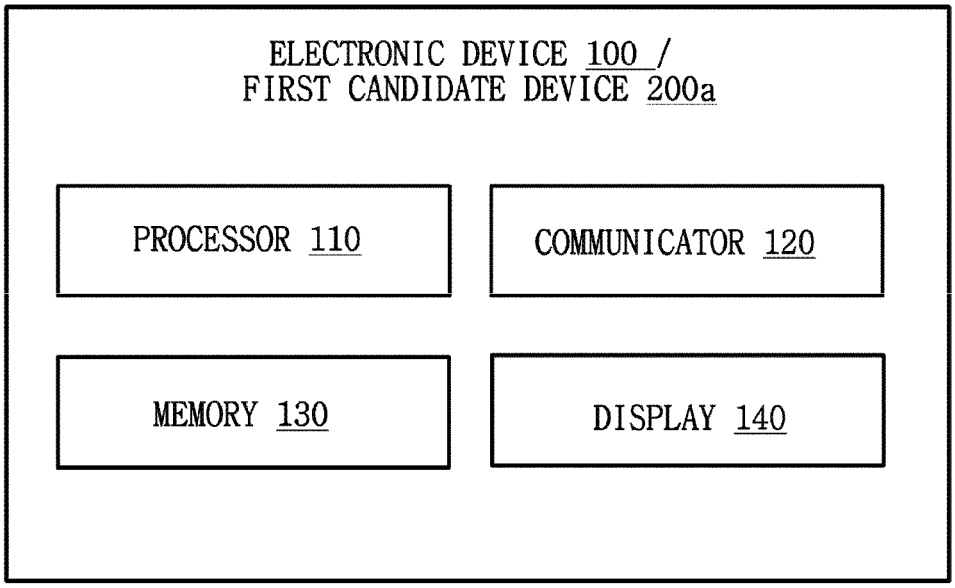
FIG. 2 illustrates the electronic device or a first candidate device for detecting a similar feature of the electronic device according to an embodiment of the disclosure.

FIG. 2 illustrates the electronic device 100 or the first candidate device 200*a* for detecting a similar feature of the electronic device 100 according to an embodiment of the disclosure.

Referring to FIG. 2, the electronic device 100 or the first candidate device 200*a* includes a processor 110, a communicator 120, a memory 130, and a display 140. The processor 110 is coupled to the memory 130, the communicator 120, and the display 140. A similar feature may include at least one of alert types, which are the same, or the same device name among the electronic device 100 and the plurality of candidate devices 200*a* to 200*n*.

Although the processor 110 and the memory 130 have been described as being separate from each other, the disclosure is not limited thereto, and the processor 110 and the memory 130 may be formed as a controller (not shown) formed as a single chip. The controller controls the overall operation of the electronic device 100. The controller may correspond to at least one processor 110. In this case, the processor 110 may be implemented as an array of a plurality of logic gates or a combination of a general-use microprocessor and the memory 130 in which a program executable by the microprocessor is stored.

In an embodiment, the processor 110 is configured to transmit a communication signal to the plurality of candidate devices 200*a* to 200*n* in the vicinity of the electronic device 100. A function code indicates configuration information of the electronic device 100. The electronic device 100 may receive candidate function codes transmitted by the plurality of candidate devices 200*a* to 200*n* based on the received communication signal. The candidate function codes transmitted by the plurality of candidate devices 200*a* to 200*n* may indicate configuration information of the plurality of candidate devices 200*a* to 200*n*. The processor 110 may be configured to determine whether the function code of the electronic device 100 matches the candidate function codes received from the plurality of candidate devices 200*a* to 200*n*. When it is determined that the function code of the electronic device 100 matches the candidate function codes, the processor 110 may perform at least one operation. The communication signal includes a Bluetooth signal, an ultrasonic signal, a wireless signal, and the like.

In an embodiment, the processor 110 may generate and transmit a unique identifier. Furthermore, the processor 110 may receive unique identifiers transmitted by the plurality of candidate devices 200*a* to 200*n*. The unique identifier may correspond to a specific frequency.

In an embodiment, the processor 110 may determine a plurality of features of the electronic device 100, an attribute related to each feature of the electronic device 100, and a value corresponding to each attribute. The processor 110 may generate a function code based on the plurality of features. Specifically, in order to generate a function code, the processor 110 may determine an attribute related to each feature of the electronic device 100 and a value corresponding to each attribute. A function code and a candidate function code may be at least one of an ultrasound Morse code, an American standard for information interchange (ASCII) code, a binary code, or a custom code. After matching function codes, the processor 110 may notify a user of the electronic device 100 of a result of the matching or automatically activate or deactivate at least one function of the electronic device 100. In addition, the processor 110 may notify the user of at least one function or automatically modify at least one function.

In an embodiment, the candidate device 200*a* filters the plurality of candidate devices 200*a* to 200*n* and the electronic device 100 based on proximity parameters. The filtering may be performed based on at least one of a position or a distance value of the plurality of candidate devices 200*a* to 200*n* and the electronic device 100. In addition, the plurality of candidate devices 200*a* to 200*n* and the electronic device 100 may perform filtering based on a speed or time value of the nearby candidate devices 200*a* to 200*n* and the electronic device 100. The electronic device 100 may filter at least one of the plurality of candidate devices 200*a* to 200*n* which leaves the vicinity of the electronic device 100. Here, the position indicates a position of the electronic device 100 or the plurality of candidate devices 200*a*-200*n* in a specific space. The distance value indicates a distance between the plurality of candidate devices 200*a* to 200*n* in the vicinity of the electronic device 100 or a distance between the electronic devices 100.

In an embodiment, the electronic device 100 may notify a user of a profile or alert mode change in a place in which a number of persons gather. For example, the embodiment may be applied in a movie theater. According to the embodiment, when most nearby users are in a silent mode, the user may change a profile of the electronic device 100 to a silent mode or a vibration mode. In addition, when other nearby users are using a high ringtone volume, the user may change a volume of the electronic device 100.

The electronic device 100 notifies the user of an augmented reality (AR) mode or a virtual reality (VR) mode to allow the user to find a nearby person or object. For example, when the user is trying to find a taxi, the user may run a camera and move the electronic device 100 to find an accurate position of a taxi that is waiting or looking for a person in a public place. The user may run the camera and move the electronic device 100 to find an exact position of a person.

In addition, the electronic device 100 may count the number of moving or stationary objects in the vicinity of the user. For example, when a plurality of nearby moving objects are present, the electronic device 100 may alert the user to avoid an accident.

The processor 110 is configured to execute instructions stored in the memory 130 and perform various processes. The memory 130 stores instructions to be executed by the processor 110. The memory 130 may include non-volatile storage elements. Examples of such non-volatile storage elements may include a magnetic hard disk, an optical disc, a floppy disk, a flash memory, or a form of an electrically programmable memory (EPROM) or electrically erasable and programmable memory (EEPROM). In addition, in some examples, the memory 130 may be considered as a non-transitory storage medium. The term "non-transitory" may indicate that a storage medium is not embodied as a carrier wave or a propagated signal. However, the term "non-transitory" should not be interpreted to mean that the memory 130 is immovable. In some examples, the memory 130 may be configured to store larger amounts of information. In a specific example, a non-transitory storage medium may store data that can change over time (for example, in random access memory (RANI) or cache).

Meanwhile, although FIG. 2 illustrates various hardware components of the electronic device 100 and the first candidate device 200*a*, it should be noted that the disclosure is not limited to the illustrated embodiment. In another embodiment, some components of the electronic device 100 and the first candidate device 200*a* may be added or excluded. In addition, the names or reference numbers of the components are used for convenience of description and do not limit the scope of the disclosure.

Figure 3:
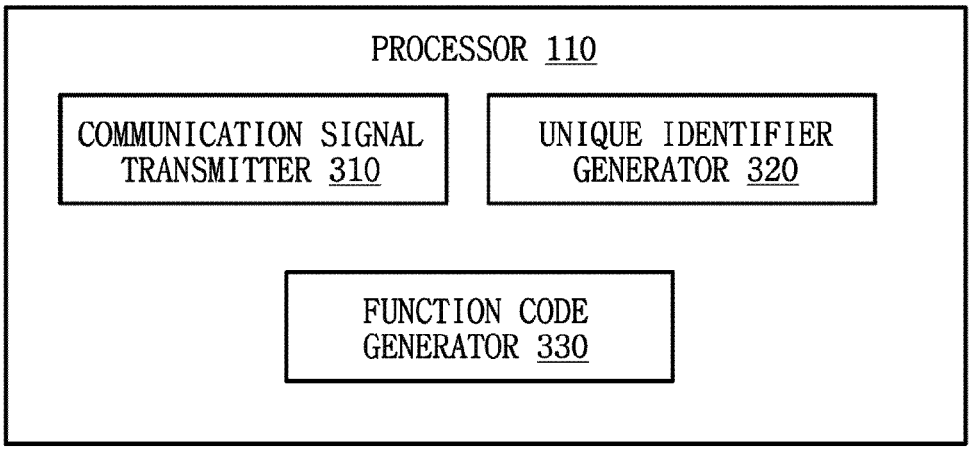
FIG. 3 illustrates a processor according to an embodiment of the disclosure.

FIG. 3 illustrates the processor 110 of the electronic device 100 according to an embodiment of the disclosure.

Referring to FIG. 3, the processor 110 includes a communication signal transmitter 310, a unique identifier generator 320, and a function code generator 330. The communication signal transmitter 310 transmits a communication signal to the plurality of candidate devices 200*a* to 200*n* in the vicinity of the electronic device 100 based on a detected event. The unique identifier generator 320 generates and regenerates unique identifiers for the plurality of candidate devices 200*a* to 200*n* and the electronic device 100. The function code generator 330 generates a function code for the electronic device 100 and candidate function codes for the plurality of candidate devices 200*a* to 200*n*.

Figure 4A:
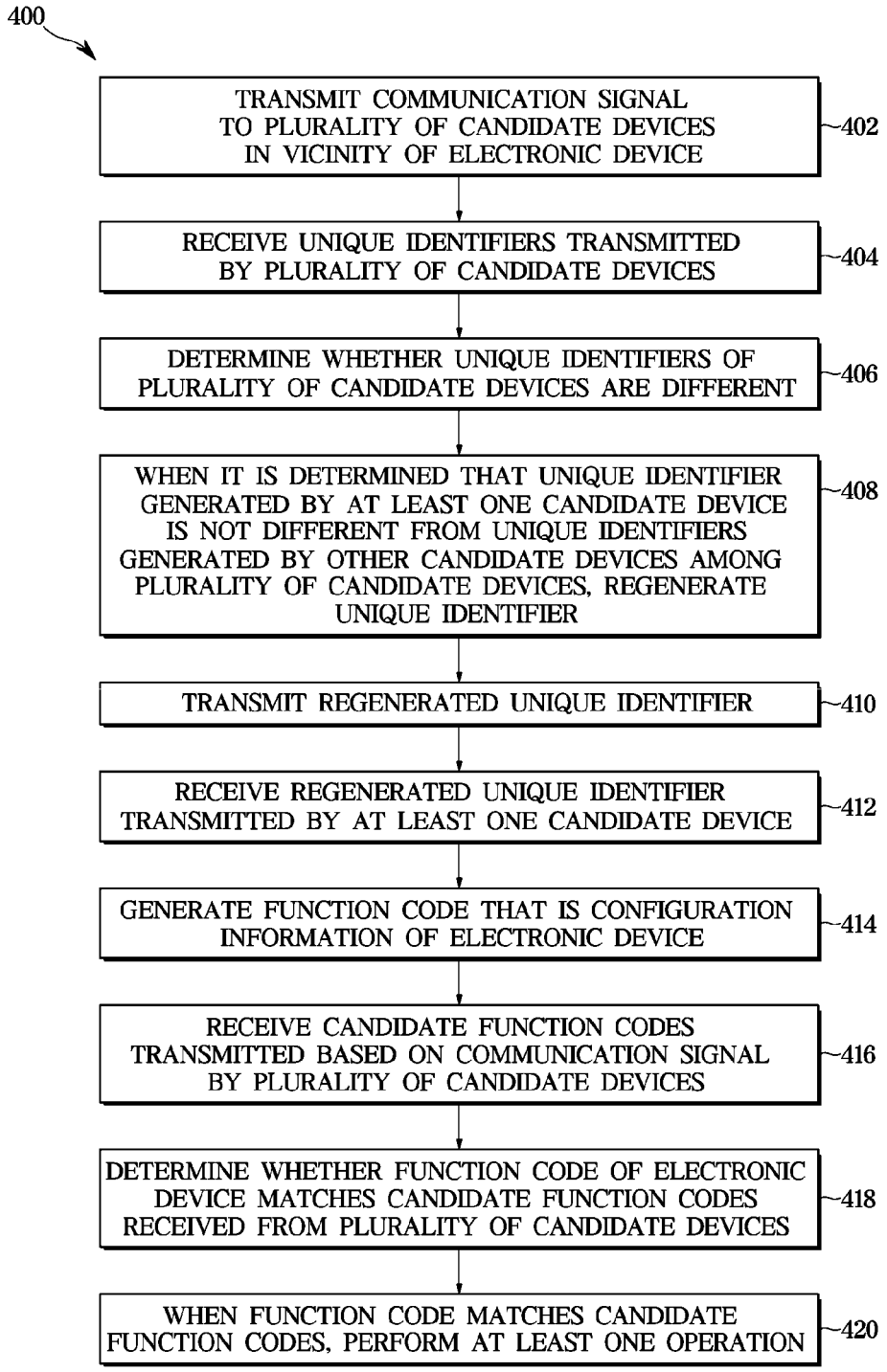
FIG. 4A illustrates a method of detecting a similar feature of an electronic device according to an embodiment of the disclosure.

FIG. 4A illustrates a method 400 of detecting a similar feature of an electronic device according to an embodiment of the disclosure.

Referring to FIG. 4A, a processor 110 transmits a communication signal to a plurality of candidate devices 200*a* to 200*n* in the vicinity of an electronic device 100 at operation 402. The processor 110 receives unique identifiers transmitted by the plurality of candidate devices 200*a* to 200*n* based on the received communication signal at operation 404. The processor 110 determines whether the unique identifier of at least one candidate device is different from the unique identifiers of other candidate devices among the plurality of candidate devices 200*a* to 200*n* at operation 406. When it is determined that the unique identifier generated by at least one candidate device is not different from the unique identifiers generated by other candidate devices among the plurality of candidate devices 200*a* to 200*n*, that is, the same unique identifier is present between the plurality of candidate devices 200*a* to 200*n*, the processor 110 regenerates a unique identifier of at least one candidate device among the plurality of candidate devices 200*a* to 200*n* at operation 408. The processor 110 may control at least one of the plurality of candidate devices 200*a* to 200*n* to transmit the regenerated unique identifier at operation 410.

The processor 110 receives the regenerated unique identifier transmitted by at least one of the plurality of candidate devices 200*a* to 200*n* at operation 412. The processor 110 generates a function code that is configuration information of the electronic device 100 at operation 414. The electronic device 100 receives candidate function codes transmitted by the plurality of candidate devices 200*a* to 200*n* at operation 416. The processor 110 determines whether the function code of the electronic device 100 matches the candidate function codes received from the plurality of candidate devices 200*a* to 200*n* at operation 418. When it is determined that the function code matches the candidate function codes, the processor 110 may perform at least one operation at operation 420.

Figure 4B:
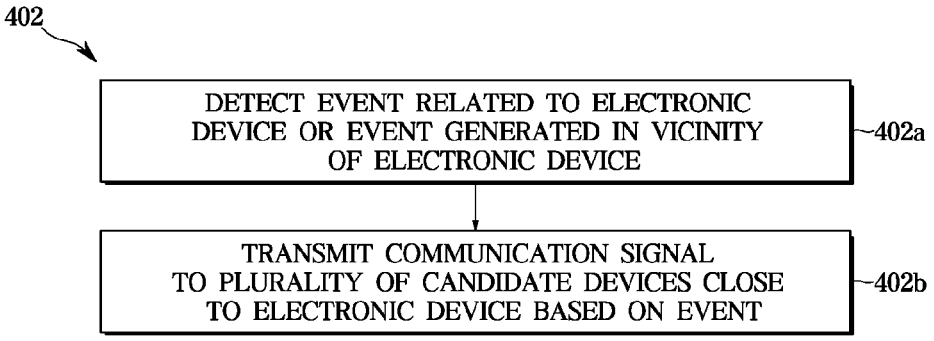
FIG. 4B illustrates a method of receiving unique identifiers associated with a plurality of candidate devices according to an embodiment of the disclosure.

FIG. 4B illustrates a method of receiving unique identifiers associated with a plurality of candidate devices according to an embodiment of the disclosure.

Referring to FIG. 4B, a processor 110 detects an event related to or in the vicinity of an electronic device 100 at operation 402*a*. The processor 110 transmits a communication signal to a plurality of candidate devices 200*a* to 200*n* close to the electronic device 100 based on the event.

Figure 4C:
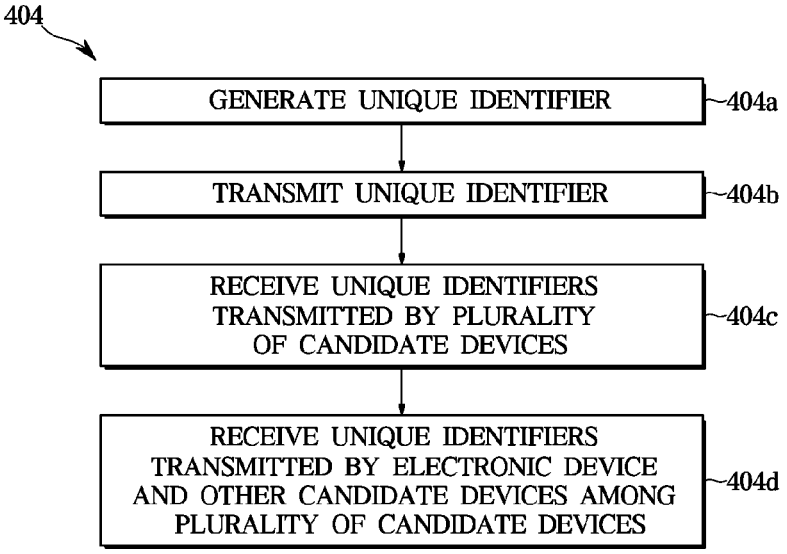
FIG. 4C illustrates a method of transmitting a communication signal to a plurality of candidate devices in the vicinity of an electronic device according to an embodiment of the disclosure.

FIG. 4C illustrates a method of transmitting a communication signal to a plurality of candidate devices in the vicinity of an electronic device according to an embodiment of the disclosure.

Referring to FIG. 4C, a processor 110 generates a unique identifier at operation 404*a* and transmits the unique identifier at operation 404*b*. An electronic device 100 may receive candidate function codes transmitted by a plurality of candidate devices 200*a* to 200*n* based on the received communication signal at operation 404*c*. The processor 110 receives unique identifiers transmitted by the electronic device 100 and other candidate devices among the plurality of candidate devices 200*a* to 200*n*.

Figure 4D:
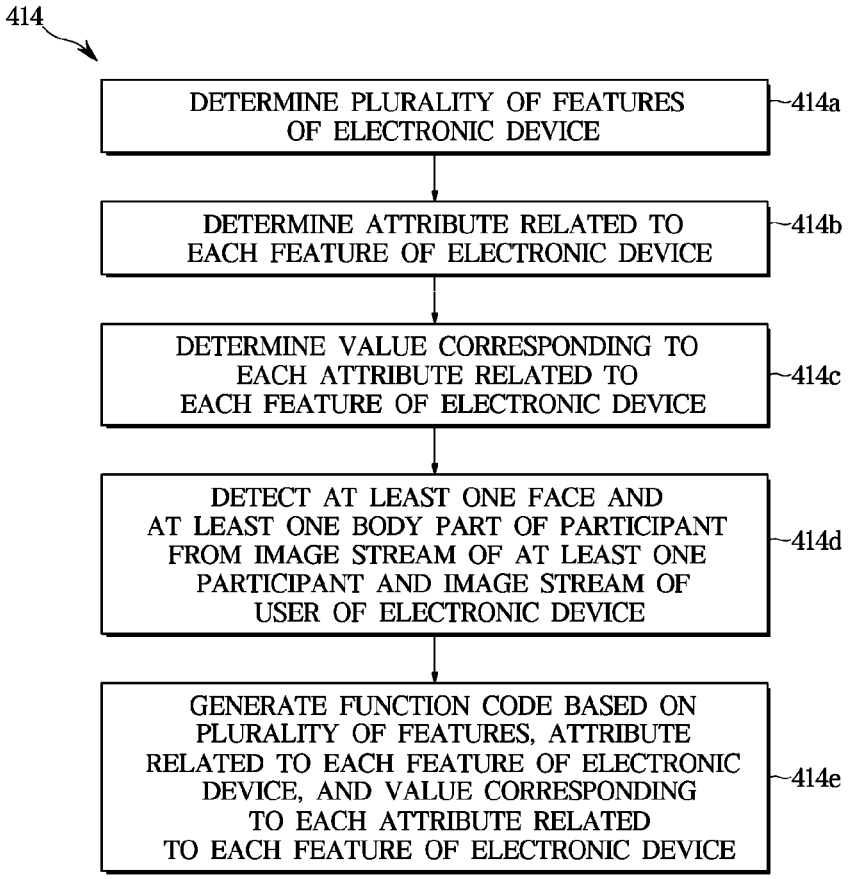
FIG. 4D illustrates a method of generating a function code according to an embodiment of the disclosure.

FIG. 4D illustrates a method of generating a function code according to an embodiment of the disclosure.

Referring to FIG. 4D, a processor 110 determines a plurality of features of an electronic device 100 at operation 414*a*. The processor 110 determines an attribute related to each feature of the electronic device 100 at operation 414*b*. The processor 110 determines a value corresponding to each attribute related to each feature of the electronic device 100 at operation 414*c*. The processor 110 detects at least one face and at least one body part of a participant from an image stream of at least one participant and an image stream of a user of an electronic device at operation 414*d*. The processor 110 generates a function code based on the plurality of features of the electronic device 100, the attribute related to each feature of the electronic device 100, and the value corresponding to each attribute related to each feature of the electronic device 100 at operation 414*e*.

FIGS. 5A to 5I illustrate an example in which a mode of an electronic device is changed using a first candidate device when the electronic device is stolen according to various embodiments of the disclosure.

Figure 5A:
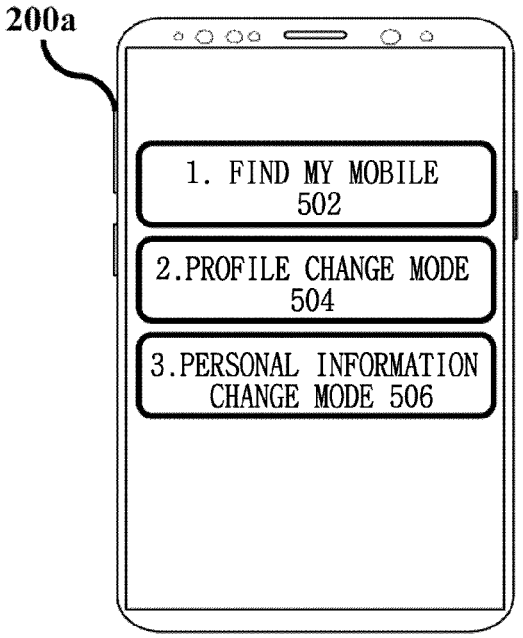
FIGS. 5A, 5B, 5C, 5D, 5E, 5F, 5G, 5H, and 5I illustrate an example in which a mode of an electronic device is changed using a first candidate device when the electronic device is stolen according to various embodiments of the disclosure.
Figure 5B:
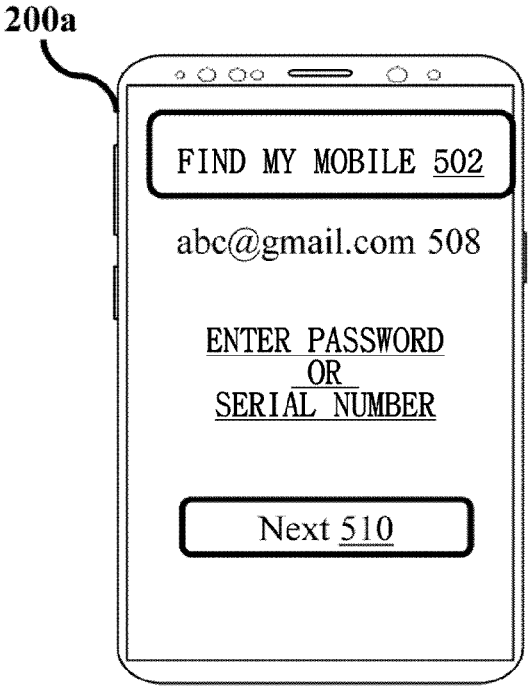
Figure 5C:
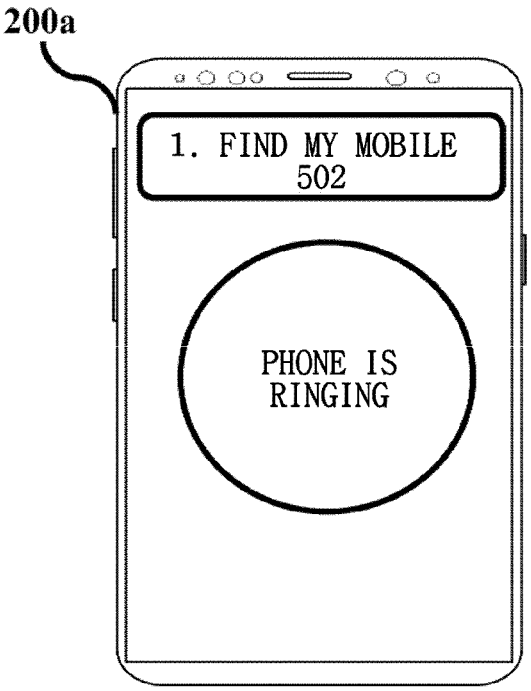
Figure 5D:
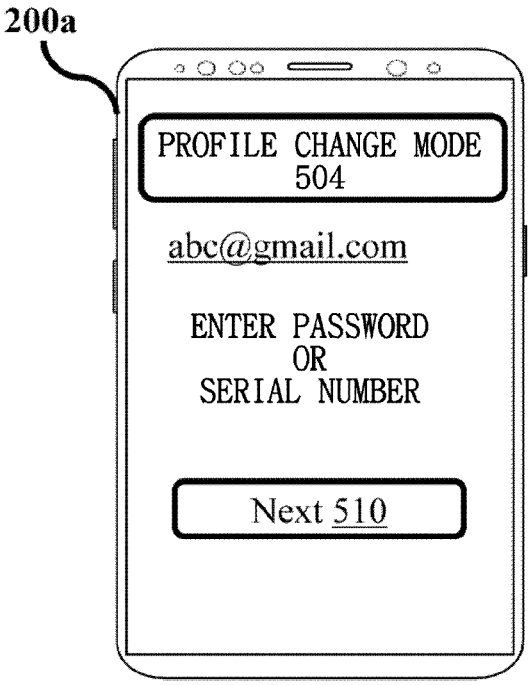
Figure 5E:
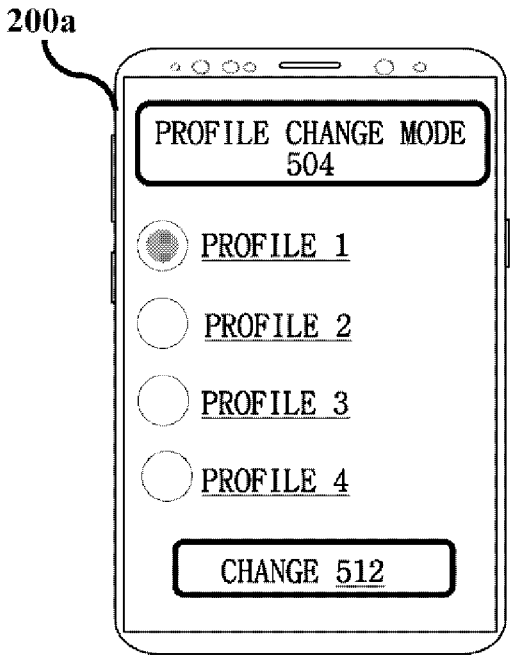
Figure 5F:
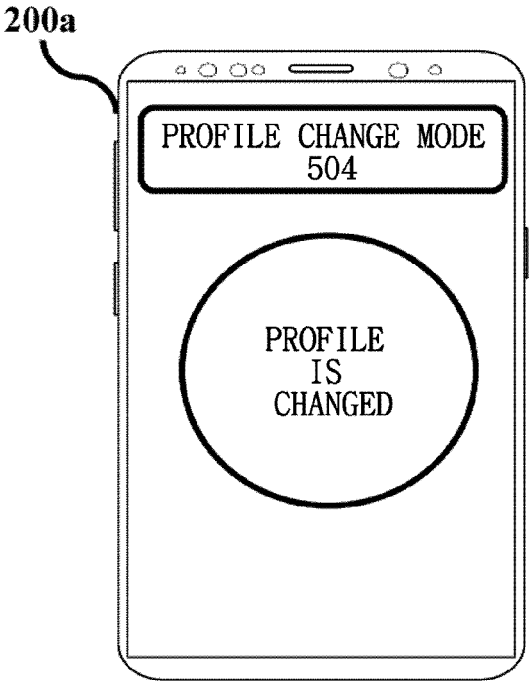
Figure 5G:
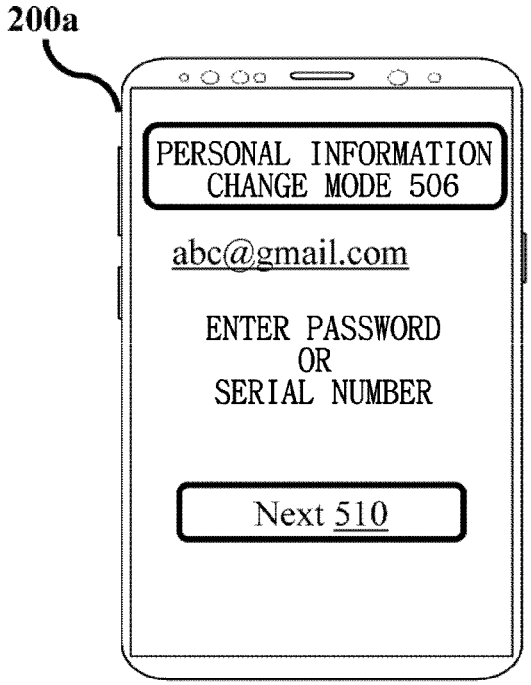
Figure 5H:
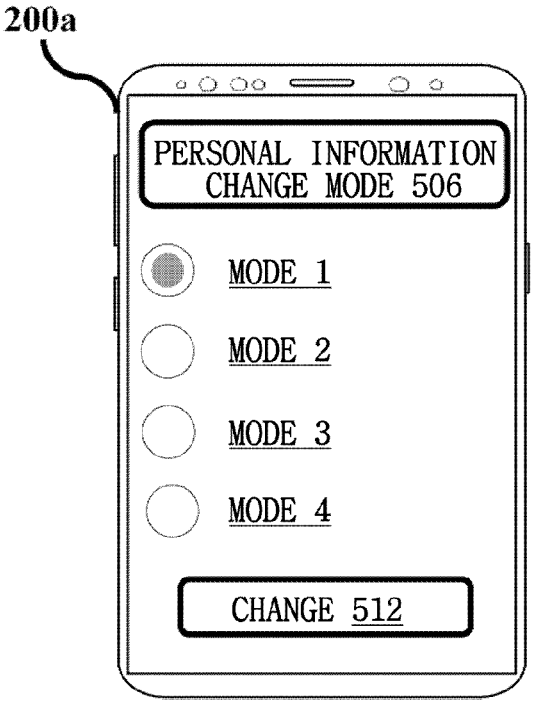
Figure 5I:
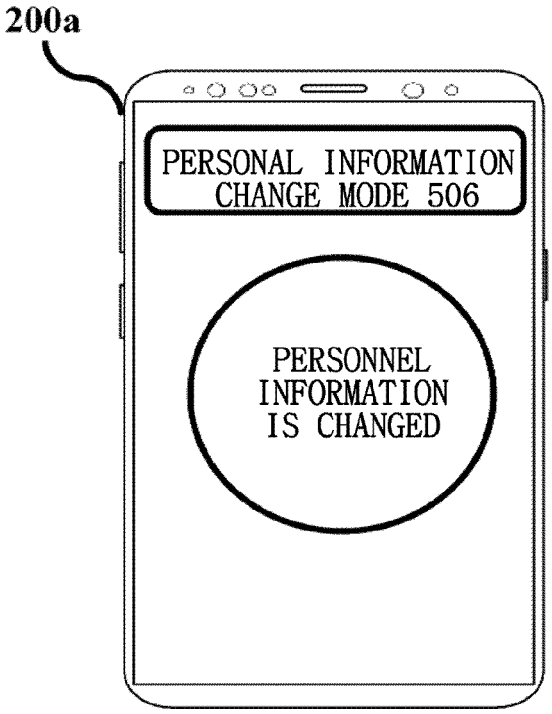

In the embodiment, it is assumed that an electronic device 100 is stolen. Referring to FIG. 5A, a user may find the electronic device 100 using a first candidate device 200*a*. The user may select an option "find my mobile 502" in the first candidate device 200*a*, and in order to find the electronic device 100, the user should enter user credentials and press a next button 510. A system notifies the user that the electronic device 100 is ringing referring to FIG. 5C. In addition, referring to FIGS. 5D to 5I, the user may change a profile mode 504 and change a personal information protection mode 506 using the first candidate device 200*a*.

FIG. 6 illustrates a randomization lookup table for an electronic device and a plurality of candidate devices according to an embodiment of the disclosure.

Referring to FIG. 6, the randomization lookup table includes an initial state 602, a first randomization 604, a first transmission 606, a second randomization 608, and a second transmission 610 of each of an electronic device 100 and a plurality of candidate devices 200*a* to 200*n*. The initial state 602, the first randomization 604, the first transmission 606, the second randomization 608, and the second transmission 610 each include an identification (ID) 612 and a frequency 614. The plurality of candidate devices 200*a* to 200*n* are detected based on the number of signals received from the plurality of candidate devices 200*a* to 200*n*. For example, assuming that the number of signals received from the plurality of candidate devices 200*a* to 200*n* is N, the first randomization 604 and the second randomization 608 are executed on the electronic device 100 and the plurality of candidate devices 200*a* to 200*n* to generate an unique frequency based on parameters such as a default detection frequency of 21,000 HZ, and assuming the number of found devices is N and a frequency assigned after randomization corresponds to, for example, feature (r): (random number× 100)+21,000 (1<random number<number of found devices), when an unique frequency is assigned to the plurality of candidate devices 200*a* to 200*n*, all of the plurality of candidate devices 200*a* to 200*n* are ready to communicate.

Figure 7A:
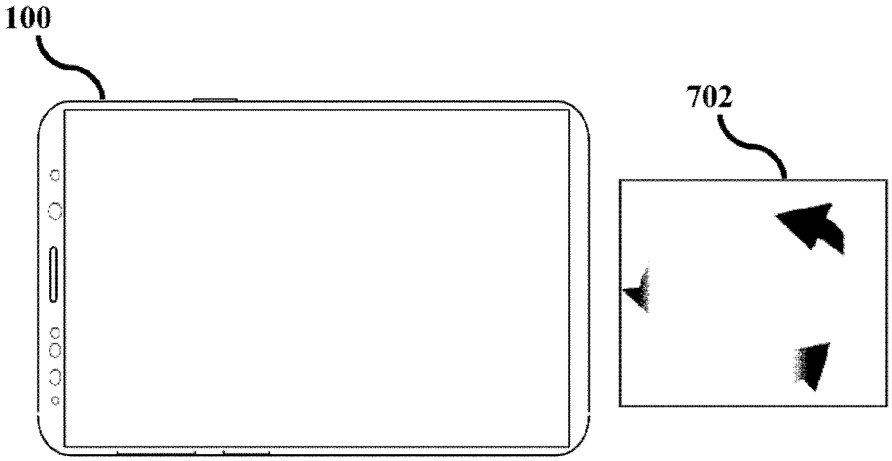
Figure 7B:
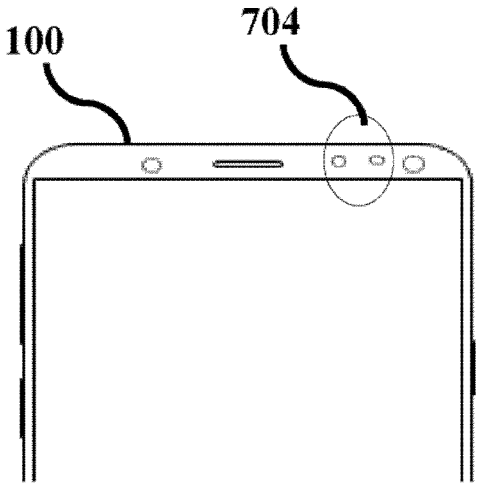

FIGS. 7A to 7C illustrate an example in which a most prominent function is identified based on a priority parameter table to prioritize features of an electronic device 100 according to various embodiments of the disclosure.

For example, prominent functions include a ringtone 706, a vibration 708, a light-emitting diode (LED) 710, a flash 712, an edge 714, a glow 716, an ambient 718, and a visibility 720. Priority parameters include an orientation of an electronic device 100, a placement of a sensor 704, a similar alert intensity, and a user presence. The orientation of the electronic device 100 is for confirming a sensor visible to a user. The placement of the sensor 704 allows it to be confirmed that the sensor 704 has visibility based on the orientation of the electronic device 100. A similar alert intensity for prominent features such as the LED 710, the flash 712, the edge 714, and the glow 716 is a luminous intensity based on set priority. The user presence is indicated toward any orientation of the electronic device 100. A processing symbol 702 shows a process of identifying the most prominent function based on the priority parameter.

In an embodiment, the prominent function based on the priority parameter is a current contextual parameter. After the prominent function is identified based on the current contextual parameter, the electronic device 100 transmits a function code based on the prominent function of the electronic device 100 to a plurality of candidate devices 200*a* to 200*n*.

The current contextual parameter is transmitted to the plurality of candidate devices 200*a* to 200*n* based on a time value of a scheduler or a user event. The current contextual parameter is monitored for a particular period of time (threshold). For example, when global positioning system (GPS) and pedometer values are both "yes," since a user is in a continuous walking state and the continuous walking state is at a certain speed, there is no need to start transmitting.

FIGS. 8A to 8E illustrate an example of the formation of an ultrasonic code according to various embodiments of the disclosure.

Referring to FIGS. 8A to 8E, a function code of an electronic device 100 and candidate function codes of a plurality of candidate devices 200*a* to 200*n* include different Morse codes.

FIG. 8F illustrates an example of an ultrasonic code table according to an embodiment of the disclosure.

Referring to FIG. 8F, the ultrasonic code table includes Morse codes 804*a* to 804*c* based on types 806 and values 808 of functions. For example, when a feature is assumed to be an "alert 802," the Morse code 804*a* for the alert 802 is "A." The various types 806 of the alert 802 include a ringtone 706, a notification 812, a vibration 708, an LED 710, a flash 712, an edge 714, and a glow 716. The Morse codes are received as function codes 810 by the electronic device 100 and the plurality of candidate devices 200*a* to 200*n*.

Figure 9A:
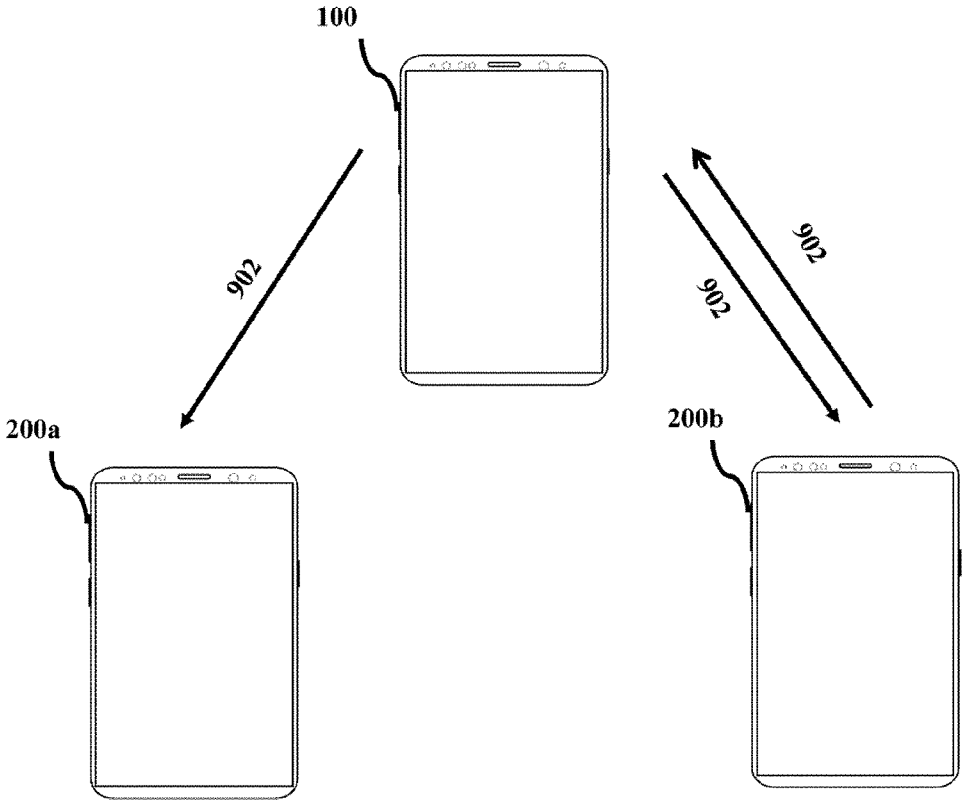

FIGS. 9A and 9B illustrate an example of a function code matched between an electronic device 100 and a plurality of candidate devices 200*a* to 200*n* according to various embodiments of the disclosure.

Referring to FIG. 9A, the electronic device 100 and the plurality of candidate devices 200*a* to 200*n* receive the same Morse code 902. Referring to FIG. 9B, it illustrates a match in Morse code 902 between the electronic device 100 and a second candidate device 200*b*, and thus, a system responds with a notification.

Figure 10A:
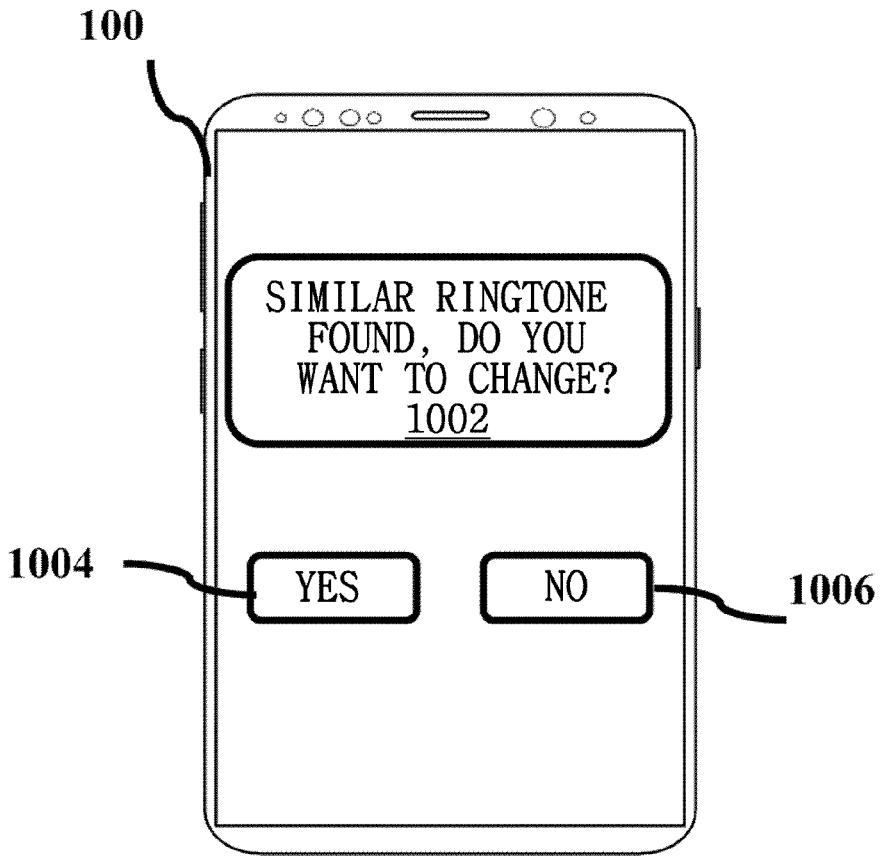
FIGS. 10A and 10B illustrate an example of a user interface for notifying a user according to various embodiments of the disclosure.
Figure 10B:
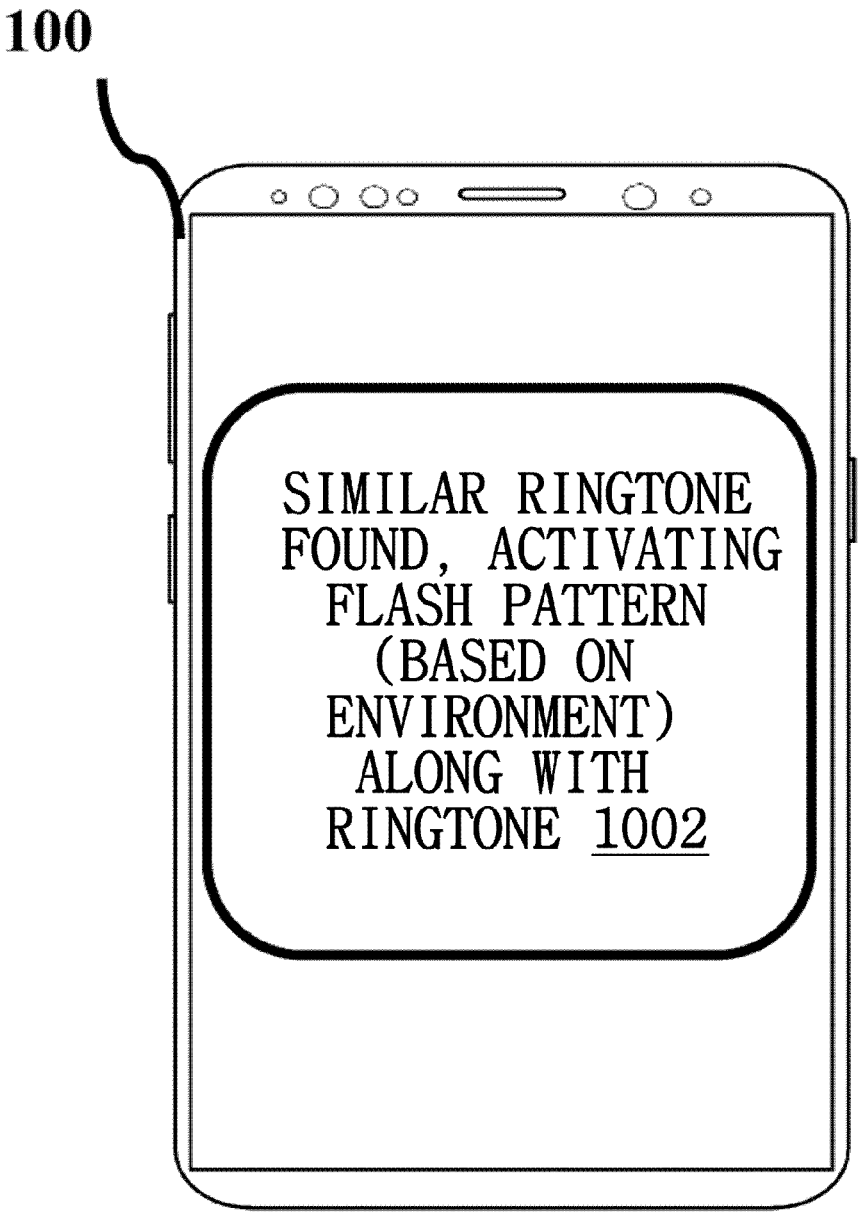

FIGS. 10A and 10B illustrate an example of a user interface for notifying a user according to various embodiments of the disclosure.

A notification 1002 allows a user to respond in a manual mode or an auto mode. The manual mode is illustrated in FIG. 10A, and the user may accept changes using a yes button 1004 or a no button 1006. The auto mode is illustrated in FIG. 10B.

FIG. 11A illustrates an example of a secondary alert of an electronic device according to an embodiment of the disclosure.

Referring to FIG. 11A, the secondary alert is determined when an electronic device 100 is at one of different device positions 1102. Based on the different device positions 1102, a user is notified with a primary alert 1104, a secondary alert 1106, or a combination of the primary alert and the secondary alert.

Figure 11B:
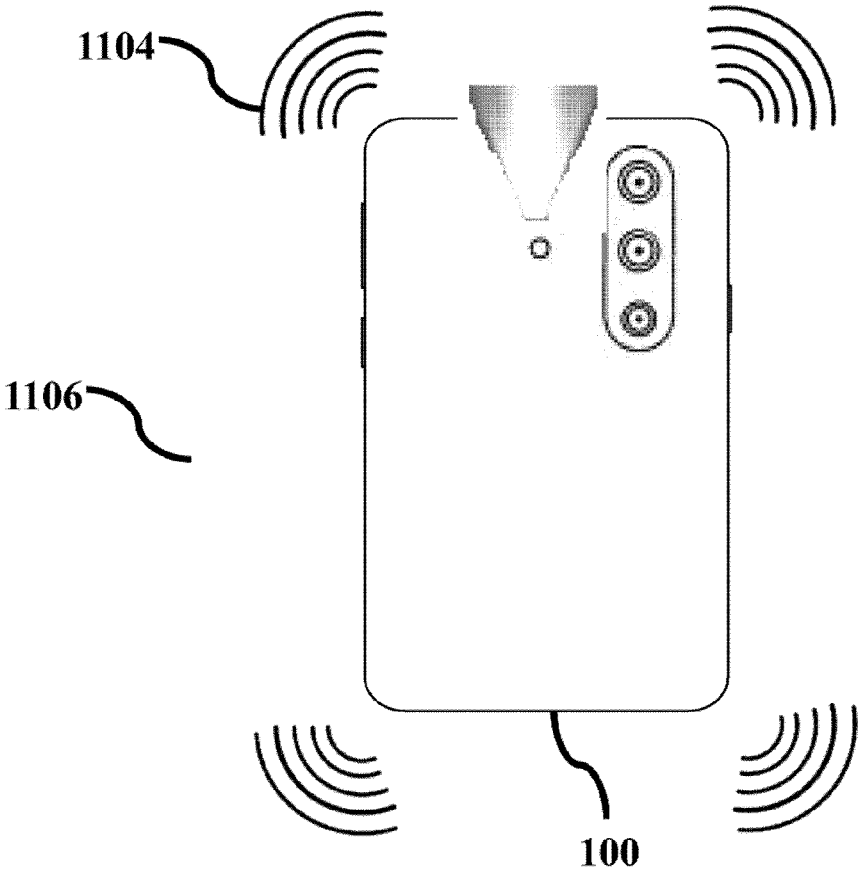
FIG. 11B illustrates an example of an electronic device having a combination of a primary alert and a secondary alert according to an embodiment of the disclosure.

FIG. 11B illustrates an example of an electronic device having a combination of a primary alert and a secondary alert according to an embodiment of the disclosure.

Referring to FIG. 11B, a primary alert 1104 is indicated by a vibration, and a secondary alert 1106 is indicated by a zigzag line.

Figure 12:
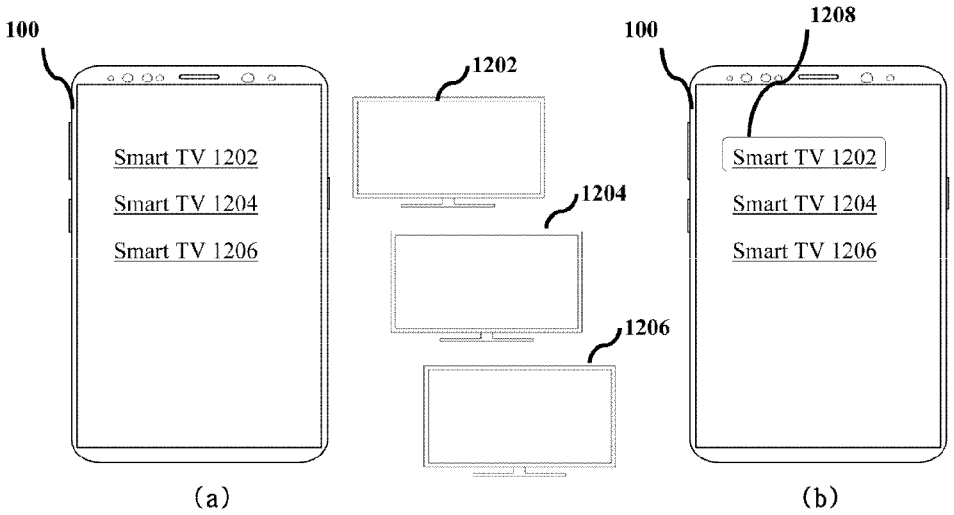
FIG. 12 illustrates an example of a user interface for notifying and suggesting a nearby smart television to a user according to an embodiment of the disclosure.

FIG. 12 illustrates an example of a user interface for notifying and suggesting a nearby smart television to a user according to an embodiment of the disclosure.

Referring to part (a) of FIG. 12, an electronic device 100 displays an indication corresponding to each of a plurality of nearby smart televisions (TVs) 1202, 1204, and 1206. Part (b) of FIG. 12 illustrates that a system notifies and suggests an appropriate smart TV 1202 to a user.

Figure 13:
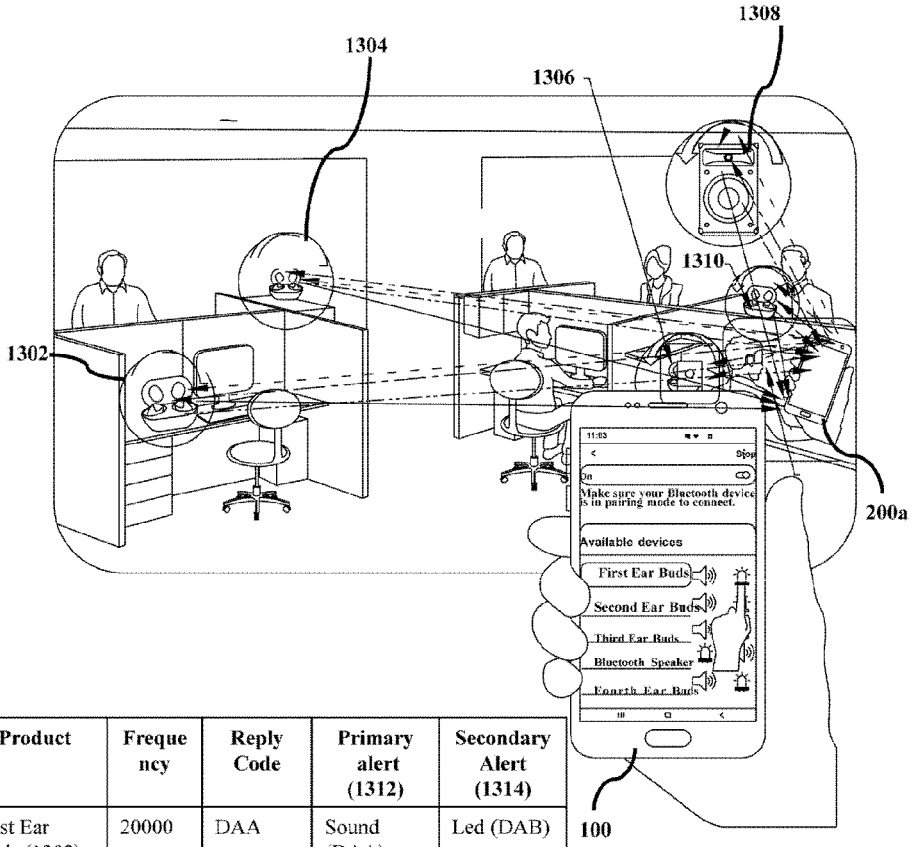
FIG. 13 illustrates an example of a user interface for pairing Bluetooth devices using an event trigger according to an embodiment of the disclosure.

FIG. 13 illustrates an example of a user interface for pairing Bluetooth devices using an event trigger according to an embodiment of the disclosure.

Referring to FIG. 13, a user of an electronic device 100 executes a Bluetooth pairing application. In this case, the electronic device 100 checks a GPS, a pedometer, and the like to check whether the user is in a specific area. A communication signal is transmitted to all candidate devices 1302 to 1308. Based on the received communication signal, all candidate devices 1302 to 1308 start randomization to complete unique frequencies and reply to the electronic device 100. Based on a distance calculated through ultrasonic waves, GPS coordinates, and the like, the candidate devices 1302 to 1308 may be filtered within a threshold distance. A communication function may be prioritized. Ultrasonic Morse codes may be generated according to a priority feature.

The generated ultrasonic Morse codes may be shared between all the candidate devices 1302 to 1308 and the electronic device 100 to confirm whether the ultrasonic mode codes match each other.

When the ultrasonic mode codes match each other, the electronic device 100 may notify a user using a secondary alert 1314. Default setting of a closest device may be highlighted. The user may click and confirm highlighted default setting of an intelligently selected device.

For example, 1. Connection (D)>Bluetooth (A)>DA, and 2. Music Application>play via Bluetooth>Audio>DAA.

Figure 14:
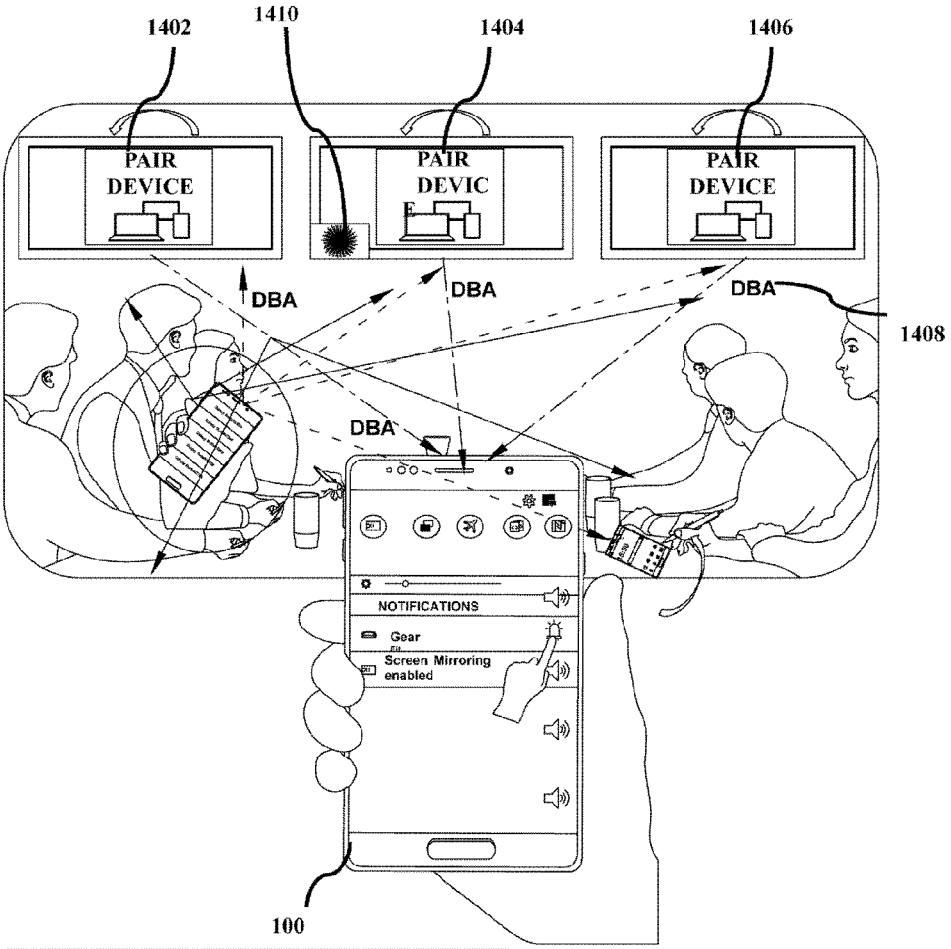
FIG. 14 illustrates an example of a user interface for pairing a smart television using an event trigger according to an embodiment of the disclosure.

FIG. 14 illustrates an example of a user interface for pairing a smart television using an event trigger according to an embodiment of the disclosure.

Referring to FIG. 14, a user of an electronic device 100 may select a candidate device 1404 for successful pairing from candidate devices 1402, 1404, and 1406, and the successful pairing may be indicated by a visual alert 1410.

Figure 15:
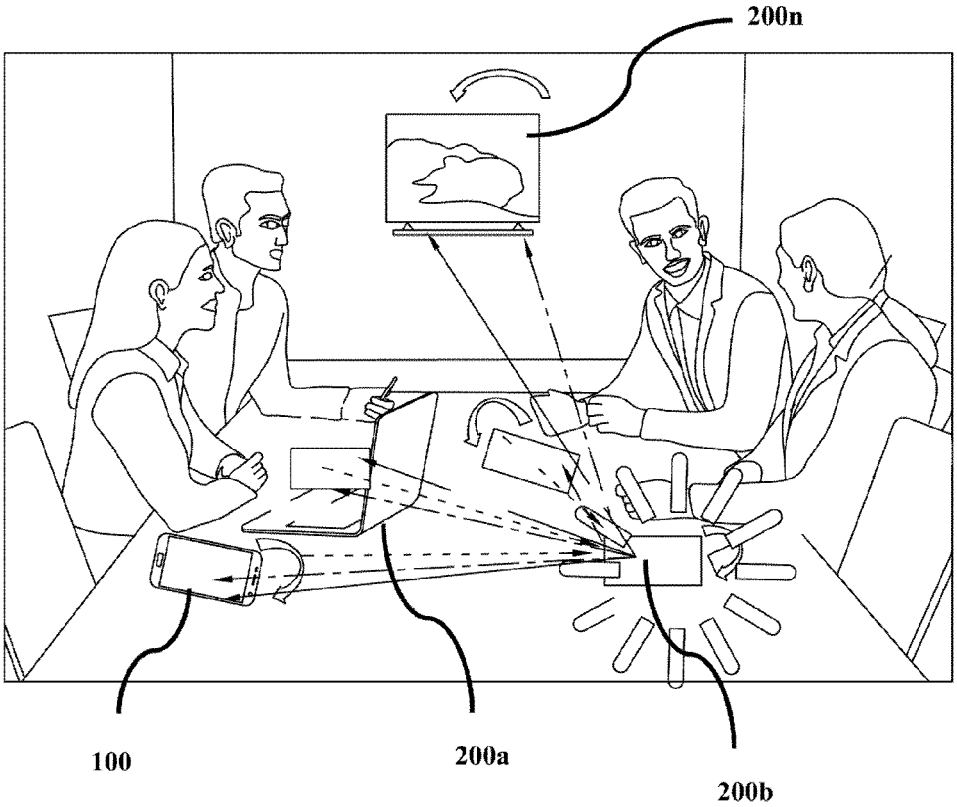
FIG. 15 illustrates an electronic device and a plurality of nearby candidate devices according to an embodiment of the disclosure.

FIG. 15 illustrates an electronic device and a plurality of nearby candidate devices according to an embodiment of the disclosure.

Referring to FIG. 15, the presence of the plurality of nearby candidate devices 200*a* to 200*n* causes confusion among users.

FIG. 16A illustrates a table for ASCII codes encoded as binary codes according to an embodiment of the disclosure.

Referring to FIG. 16A, a table 1610 includes a character 1602, an ASCII 1604 for the character, and a binary code 1606 for the ASCII 1604. For example, when characters "ABC" are transmitted to an electronic device 100, the electronic device 100 may encode the characters "ABC" as 010000010100001001000011. The encoded 010000010100001001000011 may be decoded as the characters "ABC" at the receiving side.

FIG. 16B illustrates a table for custom codes encoded as binary codes according to an embodiment of the disclosure.

Referring to FIG. 16B, a table 1612 includes codes 1608. For example, when a custom code "ABC" is encoded as "AspaceBspaceCend," the encoded code may become "00000" "11010" "00001" "11010" "00010" "11011," and the encoded value may be decoded as "ABC" at the receiving side.

According to an aspect of the disclosure, it is possible to prevent confusion that can occur due to overlapping alert functions of user terminals in a specific space.

Meanwhile, the disclosed embodiments can be implemented with recording media storing computer-executable instructions. The instructions can be stored in the form of program code and generate, when executed by a processor, a program module such that the operation of the disclosed embodiments can be performed. The recording media can be implemented as computer-readable recording media.

The computer-readable recording media include all types of recording media in which instructions that can be interpreted by a computer are stored. Examples of the computer-readable recording media include a read only memory (ROM), a RAM, a magnetic tape, a magnetic disk, a flash memory, an optical data storage device, and the like.

A machine-readable storage medium may be provided in the form of a non-transitory storage medium. Here, the term "non-transitory" simply means that the storage medium is a tangible device and does not include a signal (for example, an electromagnetic wave), but this term does not differentiate between where data is semi-permanently stored in the storage medium and where the data is temporarily stored in the storage medium. For example, the "non-transitory storage medium" may include a buffer in which data is temporarily stored.

According to an embodiment, a method according to various embodiments of the disclosure may be included and provided in a computer program product. The computer program product may be traded as a product between a seller and a buyer. The computer program product may be distributed in the form of a machine-readable storage medium (for example, a compact disc read only memory (CD-ROM)) or distributed (for example, downloaded or uploaded) online via an application store (for example, Play Store™) or between two user devices (for example, smart phones) directly. When distributed online, at least a part of a computer program product (for example, a download application (app)) may be temporarily generated or at least temporarily stored in a machine-readable storage medium, such as a memory of a manufacturer's server, a server of an application store, or a relay server.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A method of controlling an electronic device, the method comprising:

transmitting a communication signal to a plurality of candidate devices near the electronic device;

generating a function code including configuration information of the electronic device;

receiving candidate function codes including configuration information of the plurality of candidate devices from the plurality of candidate devices based on the communication signal; and when a feature of the plurality of candidate devices is determined as being similar to a feature of the electronic device based on the candidate function codes, generating at least one of an alert signal or a setting signal based on whether the function code matches the candidate function codes, wherein the generating of the at least one of the alert signal based on whether the function code matches the candidate function codes includes alerting a user of the electronic device based on the alert signal, and wherein the alerting of the user of the electronic device includes alerting the user with a combination of a primary alert and a secondary alert.

2. The method of claim 1, further comprising:

generating, by each of the electronic device and the plurality of candidate devices, a unique identifier;

transmitting the unique identifier to the plurality of candidate devices; and receiving the unique identifiers generated by the plurality of candidate devices.

3. The method of claim 2, further comprising:

confirming whether the unique identifiers of the plurality of candidate devices are different;

when the unique identifier generated by any one of the plurality of candidate devices is the same as the unique identifier of another candidate device, regenerating the unique identifiers; and receiving the regenerated unique identifiers from the plurality of candidate devices.

4. The method of claim 1, wherein the transmitting of the communication signal to the plurality of candidate devices further includes:

detecting an event near the electronic device, and transmitting the communication signal to the plurality of candidate devices near the electronic device based on the event.

5. The method of claim 1, wherein the generating of the function code further includes:

determining a plurality of features of the electronic device and attributes corresponding to the plurality of features, generating the function code based on the attribute, and transmitting the function code to the plurality of candidate devices.

6. The method of claim 1, further comprising transmitting the function code based on a current contextual parameter of the electronic device to the plurality of candidate devices.

7. The method of claim 1, wherein the function code and the candidate function code each include at least one of an ultrasonic Morse code, an American standard for information interchange (ASCII) code, a binary code, or a custom code.

8. The method of claim 1, wherein the generating of the at least one of the alert signal or the setting signal based on whether the function code matches the candidate function codes includes or activating/deactivating at least one function of the electronic device.

9. The method of claim 1, wherein the similar feature includes at least one of alert types or device names among the electronic device and the plurality of candidate devices.

10. The method of claim 1, further comprising filtering the electronic device and the plurality of candidate devices based on proximity parameters.

11. The method of claim 10, wherein the filtering further includes performing filtering based on at least one of a position of the plurality of candidate devices, a distance to the electronic device, a speed, or a time.

12. The method of claim 1, further comprising filtering an external device near the electronic device or the plurality of candidate devices.

13. The method of claim 2, wherein the unique identifier is a specific frequency.

14. An electronic device comprising:

a memory in which one or more instructions are stored; and a processor configured to execute the stored instructions, wherein, when executed, the instructions cause the processor to control to:

transmit a communication signal to a plurality of candidate devices near the electronic device, generate a function code including configuration information of the electronic device, receive candidate function codes including configuration information of the plurality of candidate devices from the plurality of candidate devices based on the communication signal, and when a feature of the plurality of candidate devices is determined as being similar to a feature of the electronic device based on the candidate function codes, generate at least one of an alert signal or a setting signal based on whether the function code matches the candidate function codes, wherein the generating of the at least one of the alert signal based on whether the function code matches the candidate function codes includes alerting a user of the electronic device based on the alert signal, and wherein the alerting of the user of the electronic device includes alerting the user with a combination of a primary alert and a secondary alert.

15. The electronic device of claim 14, wherein, when executed, the instructions further cause the processor to control to:

generate a unique identifier for each of the electronic device and the plurality of candidate devices, transmit the unique identifier to the plurality of candidate devices, and receive the unique identifiers generated by the plurality of candidate devices.

16. The electronic device of claim 15, wherein, when executed, the instructions further cause the processor to control to:

confirm whether the unique identifiers of the plurality of candidate devices are different, regenerate the unique identifiers when the unique identifier generated by any one of the plurality of candidate devices is the same as the unique identifier of another candidate device, and receive the regenerated unique identifiers from the plurality of candidate devices.

17. The electronic device of claim 15, wherein, when executed, the instructions further cause the processor to control to:

detect an event near the electronic device, and transmit the communication signal to the plurality of candidate devices near the electronic device based on the event.

18. The electronic device of claim 14, wherein, when executed, the instructions further cause the processor to control to:

determine a plurality of features of the electronic device and attributes corresponding to the plurality of features, generate the function code based on the attribute, and transmit the function code to the plurality of candidate devices.

19. The electronic device of claim 14, wherein, when executed, the instructions further cause the processor to control to transmit the function code based on a current contextual parameter of the electronic device to the plurality of candidate devices.

* * * * *